US011034508B2

(12) United States Patent
Felten

(10) Patent No.: US 11,034,508 B2
(45) Date of Patent: Jun. 15, 2021

(54) MULTI-COMPONENT APPLICATOR

(71) Applicant: BEIERSDORF AG, Hamburg (DE)

(72) Inventor: Bernhard Felten, Pinneberg (DE)

(73) Assignee: BEIERSDORF AG, Hamburg (DE)

( * ) Notice: Subject to any disclaimer, the term of this patent is extended or adjusted under 35 U.S.C. 154(b) by 0 days.

(21) Appl. No.: 16/343,960

(22) PCT Filed: Oct. 9, 2017

(86) PCT No.: PCT/EP2017/075617

§ 371 (c)(1),
(2) Date: Apr. 22, 2019

(87) PCT Pub. No.: WO2018/077597

PCT Pub. Date: May 3, 2018

(65) Prior Publication Data

US 2020/0010263 A1 Jan. 9, 2020

(30) Foreign Application Priority Data

Oct. 24, 2016 (DE) ..... 10 2016 012 650.7

(51) Int. Cl.

| | |
|---|---|
| ***B65D 83/20*** | (2006.01) |
| ***B65D 83/34*** | (2006.01) |
| ***B65D 83/64*** | (2006.01) |
| ***B65D 83/68*** | (2006.01) |
| *B65D 83/38* | (2006.01) |
| *B65D 83/14* | (2006.01) |

(52) U.S. Cl.

CPC ..... *B65D 83/345* (2013.01); *B65D 83/20* (2013.01); *B65D 83/646* (2013.01); *B65D 83/682* (2013.01); *B65D 83/384* (2013.01); *B65D 83/753* (2013.01); *B65D 2583/005* (2013.01)

(58) Field of Classification Search

CPC ..... B65D 83/682; B65D 83/14; B65D 83/16; B65D 83/48; B65D 83/207; B65D 83/20; B65D 83/646; B65D 83/384; B65D 83/753; B65D 83/34; B65D 83/345; B65D 2583/005

USPC ..... 222/135–139, 108–111, 145.5–145.6, 222/386.5, 400.5, 402.1–402.25, 559, 222/145.1, 465.1–475.1

See application file for complete search history.

(56) References Cited

U.S. PATENT DOCUMENTS

| | | | | |
|---|---|---|---|---|
| 3,303,970 A * | 2/1967 | Breslau | B65D 83/202 222/134 |
| 3,389,837 A | 6/1968 | Marand | |
| 3,478,933 A * | 11/1969 | Rousselot | B65D 83/60 222/635 |
| 3,584,789 A * | 6/1971 | Traynor | B65D 83/20 239/117 |
| 3,598,292 A | 8/1971 | Kiliany | |

(Continued)

FOREIGN PATENT DOCUMENTS

| | | |
|---|---|---|
| DE | 2128080 A1 | 12/1972 |
| DE | 19738681 A1 | 3/1999 |

(Continued)

*Primary Examiner* — Paul R Durand
*Assistant Examiner* — Andrew P Bainbridge
(74) *Attorney, Agent, or Firm* — Abel Schillinger, LLP

(57) ABSTRACT

Multi-chamber applicator (1) comprising a multi-chamber container (2) for storing at least two subcomponents, said chamber comprising a device (3) for removing a mixture of the subcomponents.

13 Claims, 11 Drawing Sheets

(56) References Cited

U.S. PATENT DOCUMENTS 3,637,114 A * 1/1972 Meshberg ..... B65D 83/682 222/135
3,809,289 A 5/1974 Komendowski
3,990,640 A * 11/1976 Laauwe ..... B65D 83/7535 239/533.1
4,595,127 A * 6/1986 Stoody ..... B05B 7/2421 222/135
4,682,689 A 7/1987 Pereira
5,092,492 A * 3/1992 Centea ..... B05C 17/00513 222/137
5,273,191 A * 12/1993 Meshberg ..... B05B 11/0067 222/105
5,624,055 A * 4/1997 Clanet ..... B65D 83/206 222/135
5,695,096 A * 12/1997 Yquel ..... B65D 83/34 222/402.18
5,779,106 A * 7/1998 Albini ..... B05B 11/3094 222/321.3
5,887,761 A 3/1999 Foster
5,944,226 A * 8/1999 Schiltz ..... B05C 17/00513 222/137
7,097,075 B2 4/2006 Peuker
7,537,139 B2 * 5/2009 Jackson ..... B05C 17/00553 222/135
8,033,429 B2 * 10/2011 Keller ..... B05C 17/00593 222/145.6
8,584,908 B2 * 11/2013 Kakuta ..... B05B 11/0067 222/380
9,475,635 B2 * 10/2016 Driskell ..... B65D 83/345
9,938,070 B2 * 4/2018 Ogata ..... B65D 83/205
2003/0150885 A1 * 8/2003 Dunne ..... B65D 83/62 222/402.24
2007/0246482 A1 * 10/2007 Goldberg ..... B05C 17/0146 222/129
2009/0108021 A1 * 4/2009 Hansen ..... C12N 15/8247 222/1
2010/0091478 A1 * 4/2010 Miller ..... F21K 2/06 362/34
2013/0112707 A1 5/2013 Hanai
2013/0221036 A1 8/2013 Ganan-Calvo
2013/0284759 A1 * 10/2013 Teramoto ..... B65D 83/20 222/94
2014/0246515 A1 * 9/2014 Nakajima ..... A61K 8/342 239/307
2016/0280449 A1 * 9/2016 Mekata ..... B65D 83/682
2020/0010263 A1 * 1/2020 Felten ..... B65D 83/20

FOREIGN PATENT DOCUMENTS

EP 0670275 A1 9/1995
EP 2204092 A1 7/2010
EP 2597055 A1 5/2013
EP 2634111 A1 9/2013
EP 2886625 A1 6/2015
EP 3064448 A1 9/2016
JP 2013079082 A 5/2013
WO 2007109229 A2 9/2007
WO 2013130883 A1 9/2013

* cited by examiner

MULTI-COMPONENT APPLICATOR

BACKGROUND OF THE INVENTION

1. Field of the Invention

Multichamber applicator having a multichamber container for the storage of at least two subcomponents, having an apparatus for the removal of a mixture of the subcomponents.

2. Discussion of Background Information

A large number of containers having two or more chambers in which partial preparations can be stored prior to mixing and use are known to a person skilled in the art from the prior art.

These multichamber containers can be subdivided roughtly into two groups. Containers in which the content of several chambers is mixed fully in a large mixing chamber before dispensing and is then provided for use (multichamber container with batchwise mixing before removal). By way of example, U.S. Pat. No. 3,809,289 A, 4,682,689 A or 7,097,075 B are cited here.

A second group consists of multichamber containers in which the removal of the partial preparations from the chambers takes place simultaneously and the subcomponent streams are combined only during removal and continuously before being dispensed (multichamber container with continuous mixing directly before and/or during dispensing).

Continuous mixing during dispensing has the advantage that only as much of the subcomponents is mixed as is necessary for the required quantity of mixed preparation (referred to as "mixture" in the following).

The prior art provides a person skilled in the art with different container variants in which the precise dispensing of a mixture is possible.

US 2010091478 A and DE 1457439 B disclose arrangements of two aerosol containers that have an actuating device for opening the valves. In the actuating device, the subcomponent streams are mixed via a static mixer and then sprayed via a single nozzle. Following completion of the spraying operation, a residue of the mixture remains in the duct system, in particular in the static mixer and the nozzle.

U.S. Pat. No. 5,887,761 A discloses a trigger pump, which is capable, by means of two pumps coupled via a trigger, of delivering two subcomponents from separate chambers and dispensing them in a mixed form.

EP 2886625 A, EP 2204092 A and EP 2597055 A teach a person skilled in the art about multichamber containers, which separate chambers made of flexible bags that are pressurized from the outside (bag-in-can system/bag-on-valve system). These individual bags are connected via separate valves. Via a common actuating device, the dispensing of a mixture of the subcomponents from the chambers is possible.

In addition to the abovementioned multichamber packaging means in which each chamber has a separate valve or pump, a person skilled in the art is also familiar with systems in which the chambers are arranged such that they are emptied via a common multiway valve such that, upon actuation of only one multiway valve, two fluid streams can be directed into separate ducts located alongside one another or ducts located concentrically one inside the other. By way of example, U.S. Pat. Nos. 3,389,837 B, 3,598,292 B and EP 2634111 A may be mentioned here for concentrically constructed valves, and WO 2013130883 A and U.S. Pat. No. 3,478,933 B may be mentioned here for valves with ducts located alongside one another.

All of these multichamber containers with continuous mixing before or during dispensing have a major drawback. If the subcomponents react with one another in such a way that solids, gels or highly viscous pastes (referred to as "residue" in the following) are formed, the residual quantities of mixture that remain in the static mixtures and/or dispensing ducts after the emptying operation can solidify and clog the mixer or the ducts. As a rule, the system is then lost, since the residues (solids) usually cannot be pushed out upon recommencement of use.

Therefore, in the case of two-component adhesives (2K adhesives), following removal it is often necessary to clean off residue-forming mixture or to replace the mixing chamber and the dispensing duct.

The aim was to remedy the lack of unlimited further use without replacing and/or cleaning parts.

SUMMARY OF THE INVENTION

It was surprising for a person skilled in the art that a multichamber container comprising the features of claim 1 allows unlimited further use without additional cleaning or replacement of structural elements.

It is advantageous when the dispensing duct has a mixing chamber, the diameter of which is greater than the diameter of the dispensing opening.

In the rest state, in which there is no dispensing of a mixture, the piston in the dispensing duct or in the mixing chamber is in a forward position and as a result closes the openings in the mutually opposite inlet ducts in the side wall of the dispensing duct or mixing chamber. The piston is designed such that it completely fills the mixing chamber as far as the dispensing opening. The dispensing opening is completely closed by the corresponding design of the piston.

The dispensing duct is advantageously designed as a one-part or multipart assembly that is connected to the stem of the valve or to the outlet of one or more pumps. The dispensing duct can be vertically movable within the dispensing head in order for example to be able to follow the movement of a valve. In a preferred embodiment, the dispensing head has on its top side a button (actuating element). When the button on the top side of the dispensing head is depressed, the assembly with the dispensing duct is also depressed. This also causes the valve stem or a pump to move and thus the valve to open or the pump to pump. Actuating elements that allow dispensing via deflection mechanisms are already known from the prior art.

In particular embodiments, this simultaneous movement of piston and valve/pump can be supported by a lever mechanism.

It is particularly preferred for the button, while being depressed, to act on a resiliently mounted pull rod, which is connected at its other end to the piston, via one or more eccentric cams which form a control curve. Alternatively, a lever system with a transmission would be within the meaning of the invention. As a result of this suspension, when the button is pressed, the piston is moved horizontally away from the dispensing opening. The resultant movement of the piston causes first of all the dispensing opening to be opened and, as it continues to move, the piston opens the two openings in the inlet ducts that lead into the mixing chamber.

The mixing chamber within the meaning of the invention is that portion of the dispensing duct that is formed between the dispensing opening and the piston when the piston is not in its rest position. In the mixing chamber, the subcomponents are mixed before the resulting mixture emerges from the dispensing opening.

The subcomponents A and B can flow through the inlet ducts into the mixing chamber. Depending on the pressure, flow cross section and viscosity and on the miscibility of the two subcomponents with one another, more or less intensive mixing takes place. The mixture then emerges through the dispensing opening at the front side of the dispensing head. As a result of the ratio of the diameter of the inlet ducts to the size of the mixing chamber and to the diameter of the outlet opening, the flow rate upon passing through the outlet opening can be controlled and thus the intensity of mixing optimized. The mixing of the subcomponents can be improved when the inlet ducts are arranged such that a turbulent flow is formed, this being advantageous according to the invention.

When the pressure on the button on the top side is released, the spring force of the valve springs ensures that the assembly is moved up again. As a result, the piston moves back into its starting position via the suspension—in particular pull rod. This movement of the piston back in the direction of the dispensing opening causes the mixing chamber to be emptied via the dispensing opening and ultimately the inlet openings of the mixing chamber to be closed. In order to empty the mixing chamber in a residue-free manner, the piston has to fill the dispensing duct in a form-fitting manner. Within the meaning of the invention, form-fitting should be understood as meaning that, between the piston and dispensing duct inner wall, there are no gaps through which the preparation mixture can flow past the piston. Therefore, it is advantageous to provide the piston with a slight oversize. As a result of the elasticity of the piston and/or of the dispensing duct, effective sealing is achieved by the oversize.

If the piston and/or dispensing duct is made of such an inelastic material (for example metal) or too elastic material (for example silicone elastomer) that sealing cannot be achieved by an "oversize piston", it is advantageous, for better sealing of the piston with respect to the dispensing duct inner wall and/or the mixing chamber, to provide the piston with piston rings, annular seals, finlike sealing lips, lamellar seals and/or equivalent sealing means.

As soon as the mixing chamber has been emptied and the piston is in its farthest forward position, the dispensing opening is also closed. This ensures that no subcomponents remain in the mixing chamber and react with one another and/or dry out and thus clog or stick the dispensing duct.

It is advantageous to implement a safety arrangement in the dispensing system, said safety arrangement preventing dispensing as soon as a subcomponent is no longer available.

It is particularly advantageous to arrange, in one or more dispensing ducts, a safety device that allows subcomponents to be mixed and the mixture of subcomponents to emerge only when at least one subcomponent is available for dispensing.

Thus, with such a safety device, for example when the multichamber applicator is used for cosmetic or dermatological preparations, it is possible to prevent subcomponents considered to be incompatible with the skin in a pure form from being applied in an unmixed form. The simplest situation is the application of a mixture made of a very acidic or very basic subcomponent with a subcomponent that equalizes the pH of the mixture to a skin-compatible pH (buffer system). If the buffering subcomponent has been used up, the acidic or basic subcomponent must not be applied on its own.

One technical example would be a reactive resin system (two-component adhesive made of resin and curing agent), in which the resin must not be dispensed without admixing curing agent.

This safety device comprises preferably a device that reacts to the hydraulic pressure of a component by moving a structural element. As long as this structural element is in its rest position, it blocks the dispensing of the other component. This can take place by the closure of the duct or by blocking the movement of the piston of the mixing chamber. As soon as the pressure in the duct of subcomponent A rises, the structural element is moved and as a result allows the mixing chamber piston to move or opens the cross section of the subcomponent B.

If both subcomponents are critical in a pure, unmixed state, the safety arrangement can be implemented in both ducts. As a result, the pistons of both subcomponents are blocked independently of one another. Only when the pressure has risen in both ducts on account of the subcomponents is the movement of the mixing chamber piston allowed. Only in this way can the subcomponents flow into the chamber and emerge as a mixture through the dispensing opening.

According to the invention, a safety device can be designed such that, in the connecting duct (duct that connects a storage chamber for a subcomponent to the mixing chamber), a safety piston is arranged. If a pressure builds up in the connecting duct, the safety piston moves from its rest position into an active position and as a result allows the piston to move in the mixing chamber. As a result of the withdrawal of the mixing chamber piston, the inlet openings of the mixing chamber are opened, with the result that the subcomponent can flow into the mixing chamber.

BRIEF DESCRIPTION OF THE DRAWINGS

The invention is explained in more detail with reference to the schematic drawings of two exemplary embodiments. For simplification, the structure and function are explained in each case using a multichamber container having only two chambers. However, this is not intended to have a limiting effect on the invention. Analogously to the arrangement of two chambers with two subcomponents, it is also possible for more than two chambers having more than two subcomponents to be realized in the multichamber applicator according to the invention.

Figure 1:
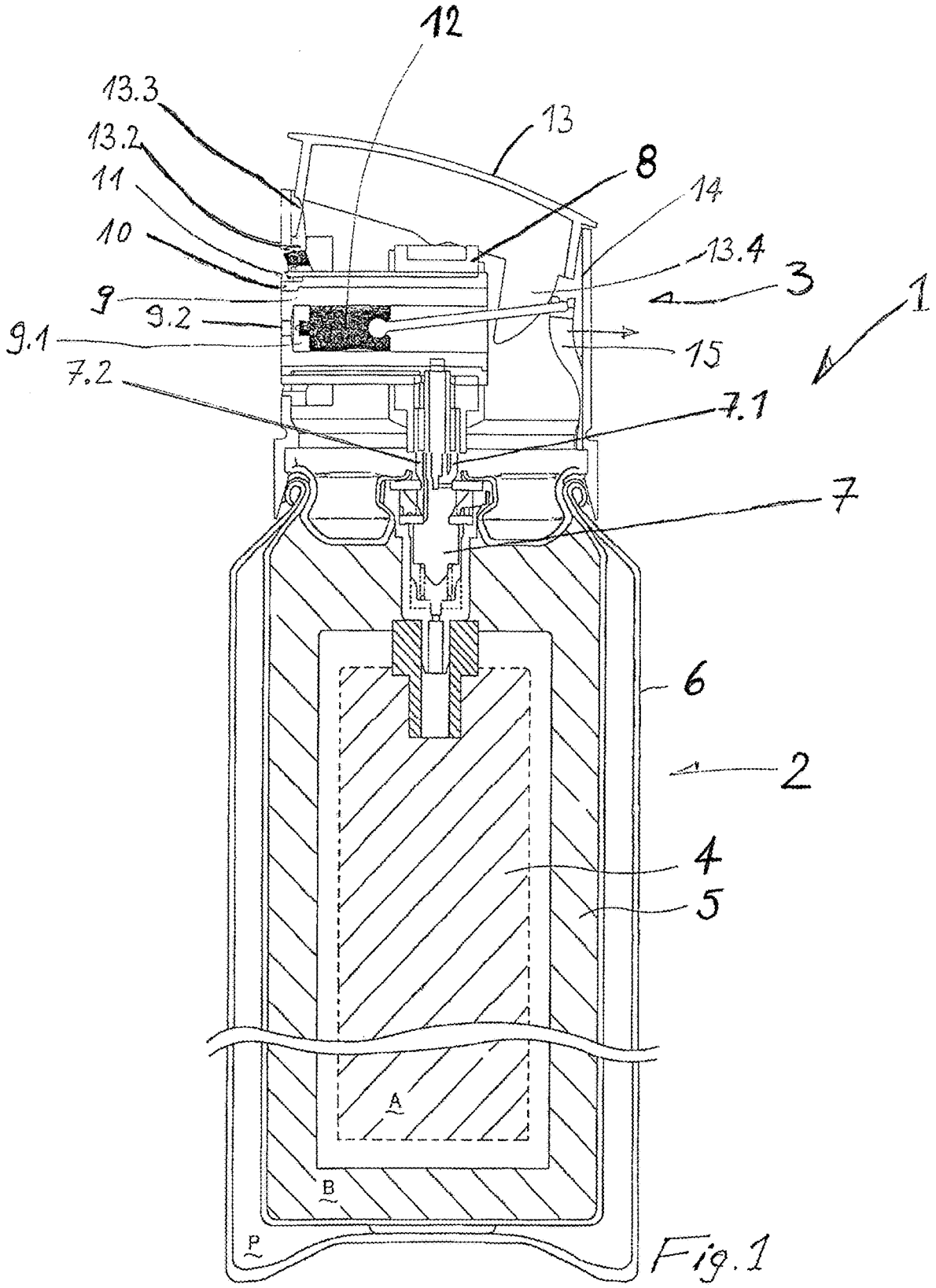
FIG. 1 shows a particular embodiment of the multichamber applicator

1/100 Multichamber applicator
2/102 Multichamber container
3/103 Dispensing head
4/104 Chamber for partial preparation

5/105 Chamber for partial preparation
6/106 Container
7/107 Valve having coaxially arranged ducts 7.1/107.1 and 7.2/107.2
8 Valve attachment
9 Inner duct element with mixing chamber 9.1, dispensing opening 92, passages 9.3 and 9.5, connecting duct 9.4
10 Central duct element with passages 10.1 and 10.3, connecting duct 10.2
11 Outer duct element with passage 11.1
12/112/212 Mixing chamber piston with protrusion 12.1
13/113 Actuating element with button 13.1/113.1, button holder 13.2, film hinge 13.3 and eccentric cams 13.4
14/114 Casing
15/115 Bending spring
16/116 Pull rod
109/209 Mixing chamber with dispensing opening 109.1 and inlet openings 109.3/209.3 and 109.5/209.5
120 Spring element
121/221 Safety piston with blocking element 121.1
122/222 Connecting duct
123/223 Connecting duct
224 Safety piston
A Subcomponent A
B Subcomponent B
P Gas pressure

DETAILED DESCRIPTION OF EMBODIMENTS OF THE INVENTION

FIG. 1 shows a multichamber applicator (1) according to the invention, having a multichamber container (2) with a removal apparatus (3), referred to as "dispensing head" in the following text. This container (2) contains two chambers (4) and (5), which are enclosed by the container (6). The container (2) is closed with a specific valve (7) from which the subcomponents contained in the chambers can emerge separately. In the interior of the container, the two ducts of the valve are each connected to a bag made of composite plastic/aluminum film, the chambers, which are filled with the subcomponents (A) and (B). The container is subjected to a positive gas pressure (P) (compressed air or some other propellant), which exerts a pressure on the chambers (4) and (5) (bag-in-can arrangement, for example multichamber container according to EP 2634111 A).

The dispensing head (3) has a cylindrical casing (14), via which it is held on the multichamber container (2).

When the valve is pressed vertically into the can by way of its stem, the openings in the valve are moved relative to rubber seals and the subcomponents flow out of the chambers, on account of the positive pressure, through the coaxially arranged ducts (7.1) and (7.2) and into the valve attachment (8). The valve is pressed in by means of the actuating element (13), which is anchored in the cylindrical casing (14) via the button holder (13.2). Via the film hinge (13.3), the button (13.1) is connected movably to the button holder (13.2). The button (13.1) bears on the valve attachment (8). As a result of the button being pressed, the valve attachment is pressed onto the valve (7), which opens and releases the subcomponents into the valve attachment.

Figure 2:
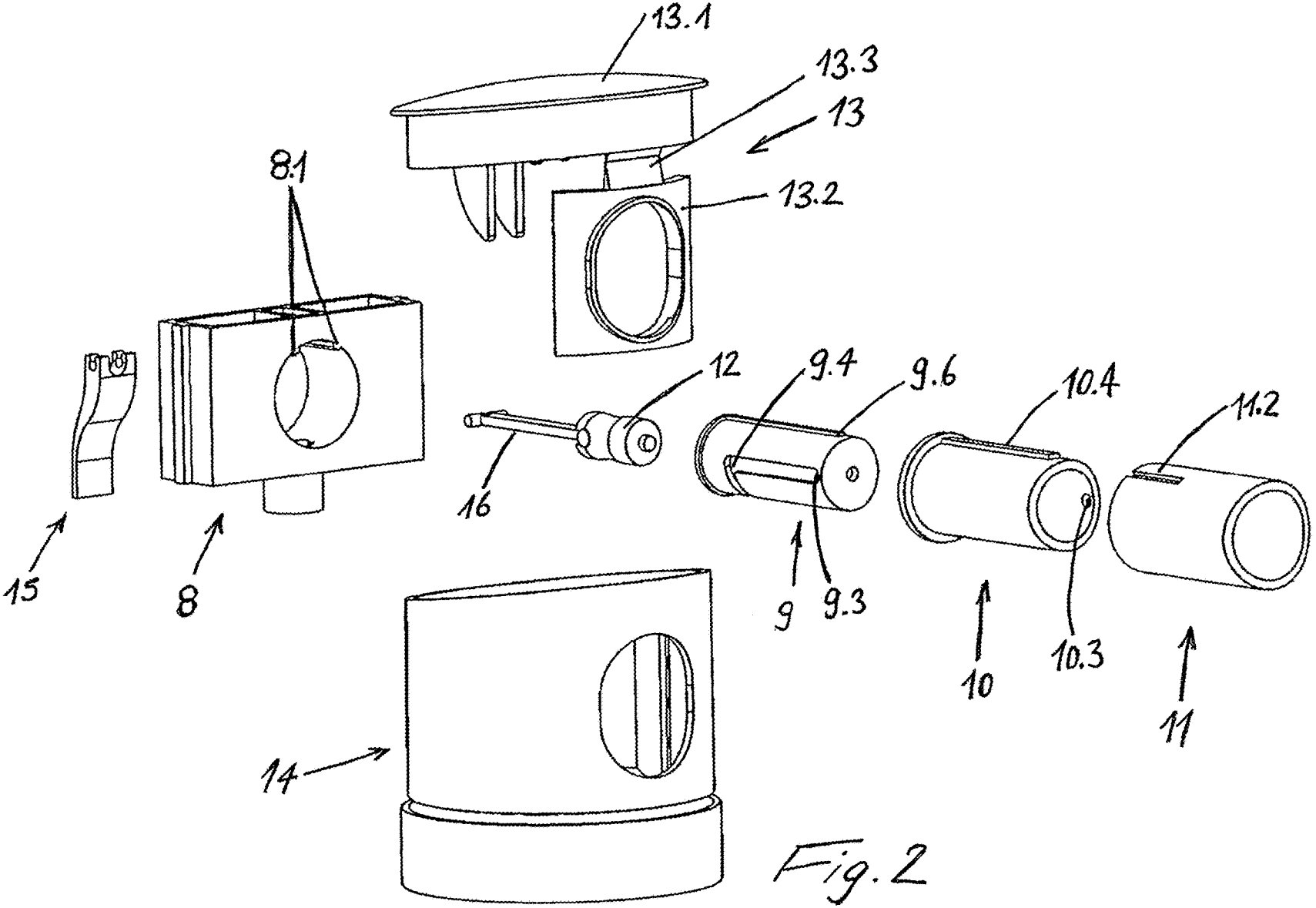
FIGS. 2 to 4 show the dispensing head in an exploded illustration from different perspectives FIGS. 5*a* to 5*c* schematically show the piston movement in the dispensing head during dispensing
Figure 3:
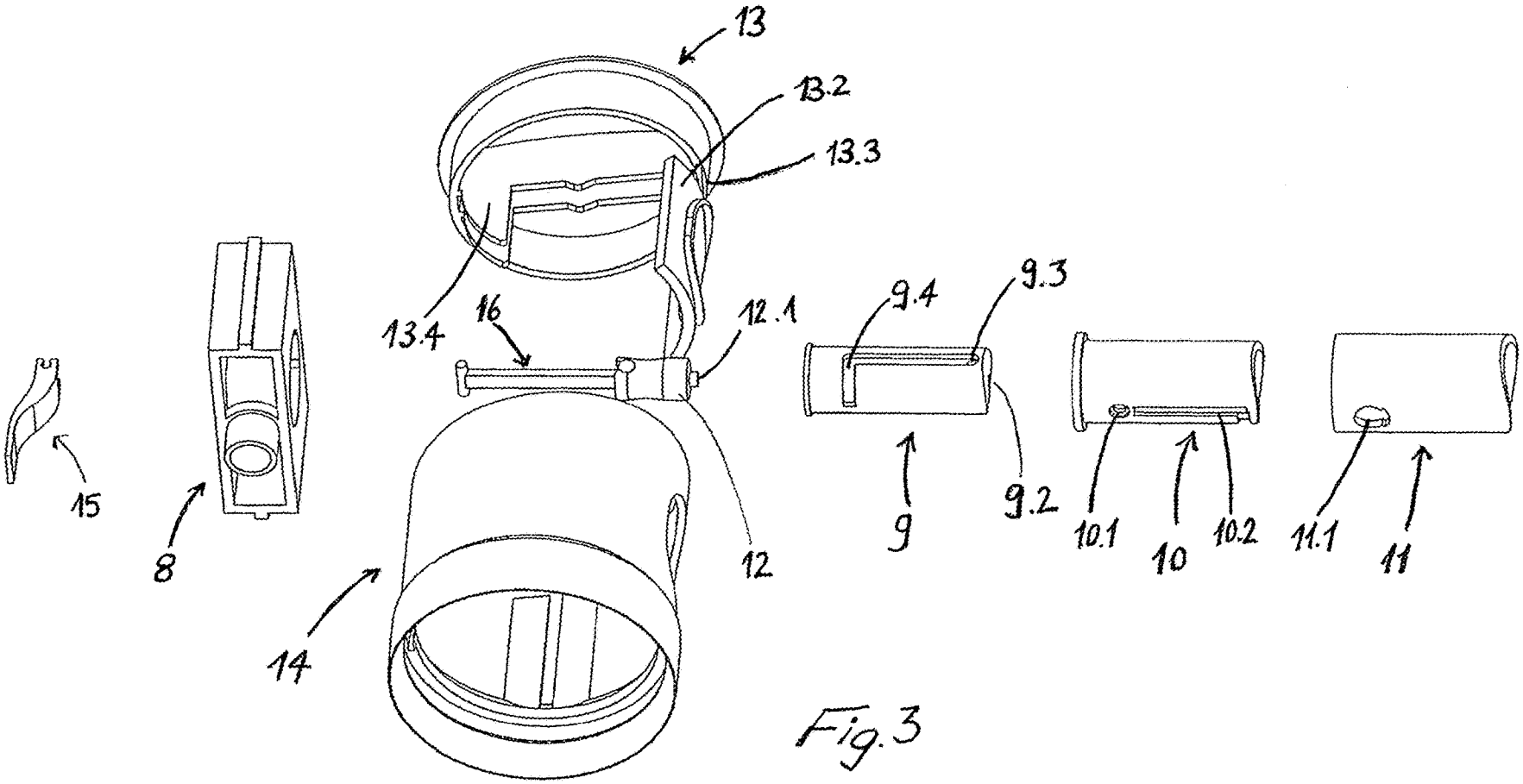
Figure 4:
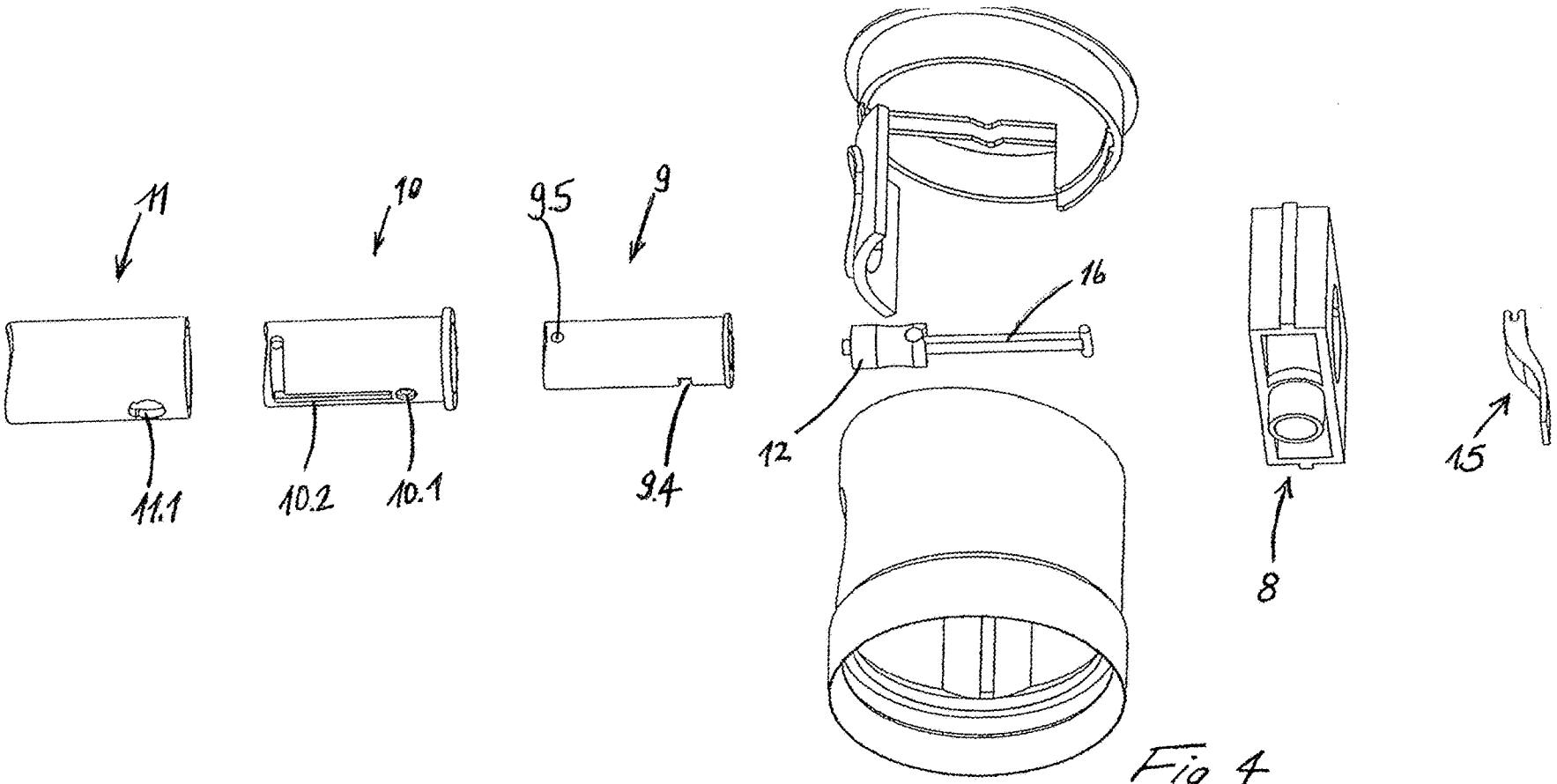

For greater understanding, the dispensing head is reproduced in FIGS. 2, 3 and 4 in an exploded illustration.

The central part in the dispensing head is the valve attachment (8), into which the concentrically arranged ducts (7.1) and (7.2) of the valve (also referred to as stem) lead. The subcomponents A and B are conducted via a duct system formed from three concentrically arranged, cylindrical duct elements (9), (10) and (11). The inner duct element (9) has the mixing chamber (9.1) in its interior and the nozzle opening (9.2) at its end.

In the dispensing head, the two subcomponents are introduced into the interior of the inner duct element (9), which serves as mixing chamber, from the valve attachment (8) through the connecting ducts (9.4) and (10.2), formed by the duct elements (9), (10) and (11), and the passages (9.3), (9.5), (10.1), (10.3) and (11.1).

Figure 6:
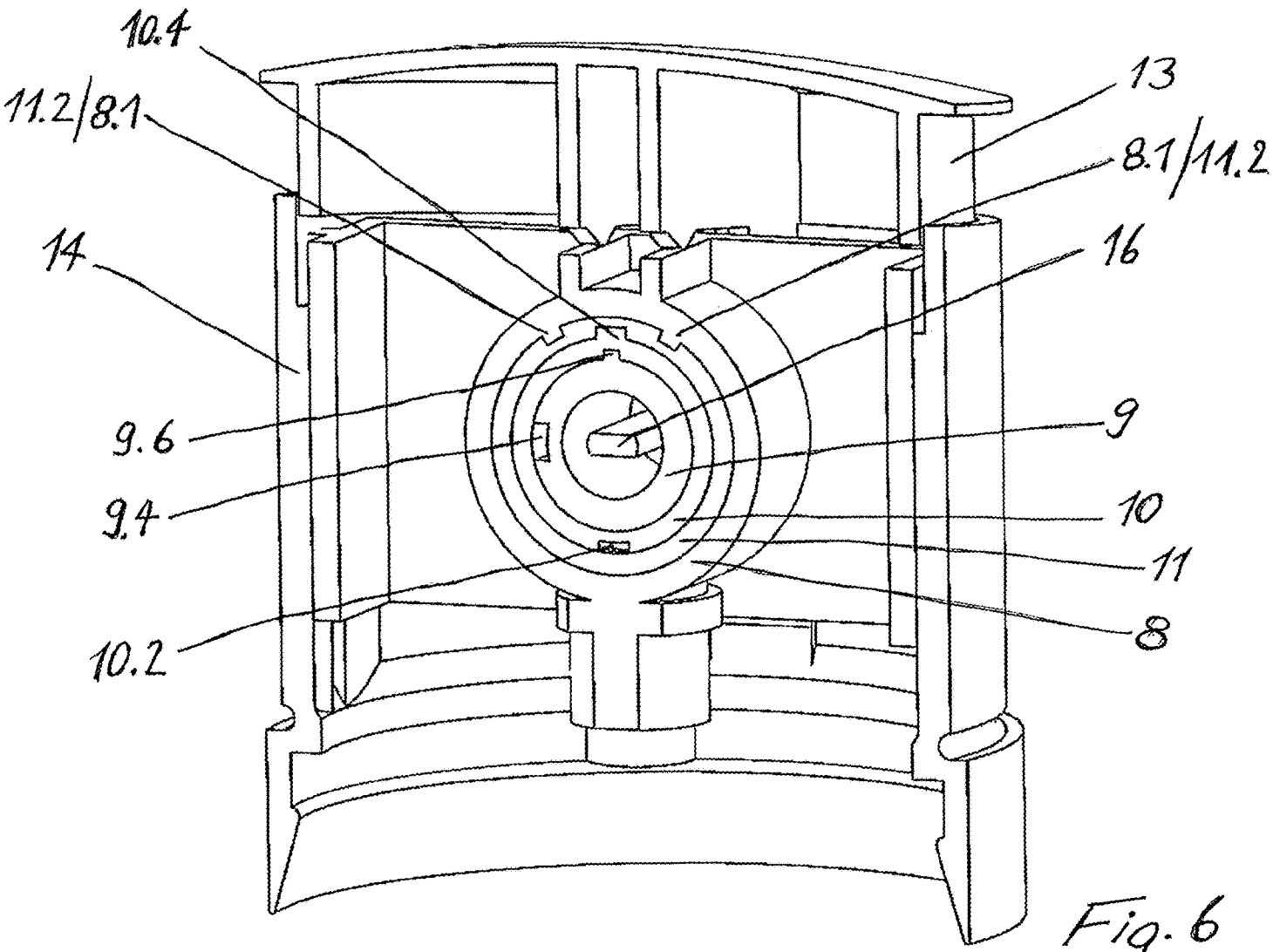
FIG. 6 shows a cross section through the duct-forming elements FIG. 7 schematically shows a second embodiment of a multichamber applicator in a front view (FIG. 7*a*) and a side view (FIG. 7*b*)

In order to orient the duct elements (9), (10) and (11) relative to one another and to the valve attachment (8), the valve attachment and duct elements have corresponding grooves and protrusions (8.1), (9.6), (10.4) and (11.2). (FIG. 6).

The mixing chamber (9.1) transitions into the dispensing duct (9.2), which ends with its dispensing opening in the region of the lateral surface of the dispensing head.

In the interior of the inner duct element (9), a piston (12) is arranged such that it closes the mixing chamber in a sealed manner. The mixing chamber piston (12) has, on its side facing the dispensing duct, a protrusion (12.1) that has the dimensions of the dispensing duct (9.2).

In order to dispense the mixed subcomponents A and B, the button (13.1) is depressed, with the result that the valve (7) opens and releases the subcomponents into the valve attachment. Simultaneously with the opening of the valve, the mixing chamber piston (12) is retracted such that the eccentric cams (13.4) act on the bending spring (15) and the bending string is moved away from the dispensing duct in the direction (W). Via the pull rod (16), the mixing chamber piston (12) is connected to the bending spring (15) such that the mixing chamber piston follows the movement of the bending spring (15). If the mixing chamber piston is retracted, the dispensing duct becomes passable and the passages (9.3) and (9.5) are opened. The subcomponents A and B can flow into the mixing chamber, mix together and leave the mixing chamber as a mixture AB via the dispensing duct. This process is schematically illustrated in FIGS. 5*a* to 5*c*.

Figure 5A:
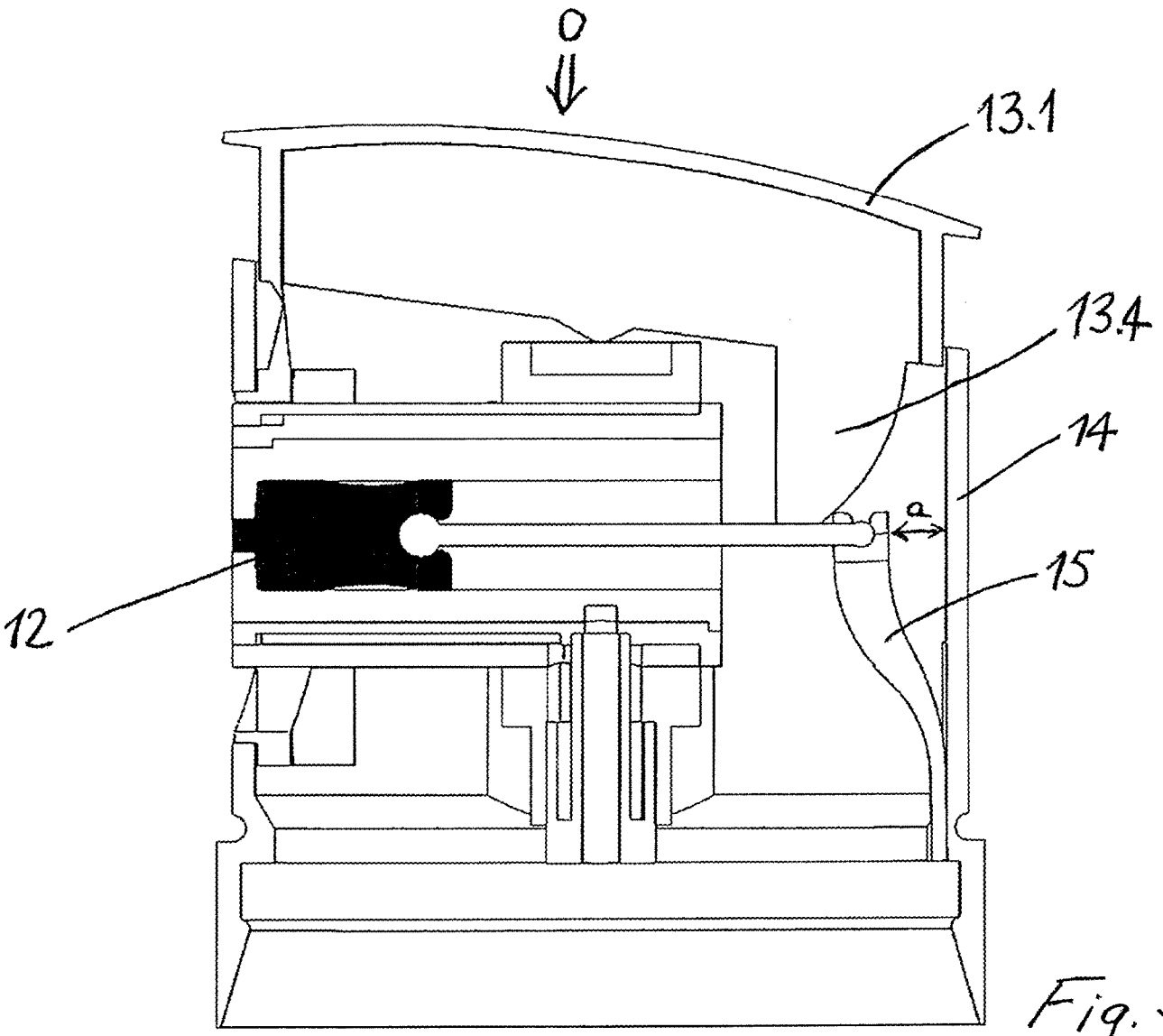

FIG. 5*a* shows a state in which the button (13.1) has not been pressed. The mixing chamber piston (12) in this case fills the mixing chamber and the dispensing duct. The passages (9.3) and (9.5) are blocked by the mixing chamber piston.

Figure 5B:
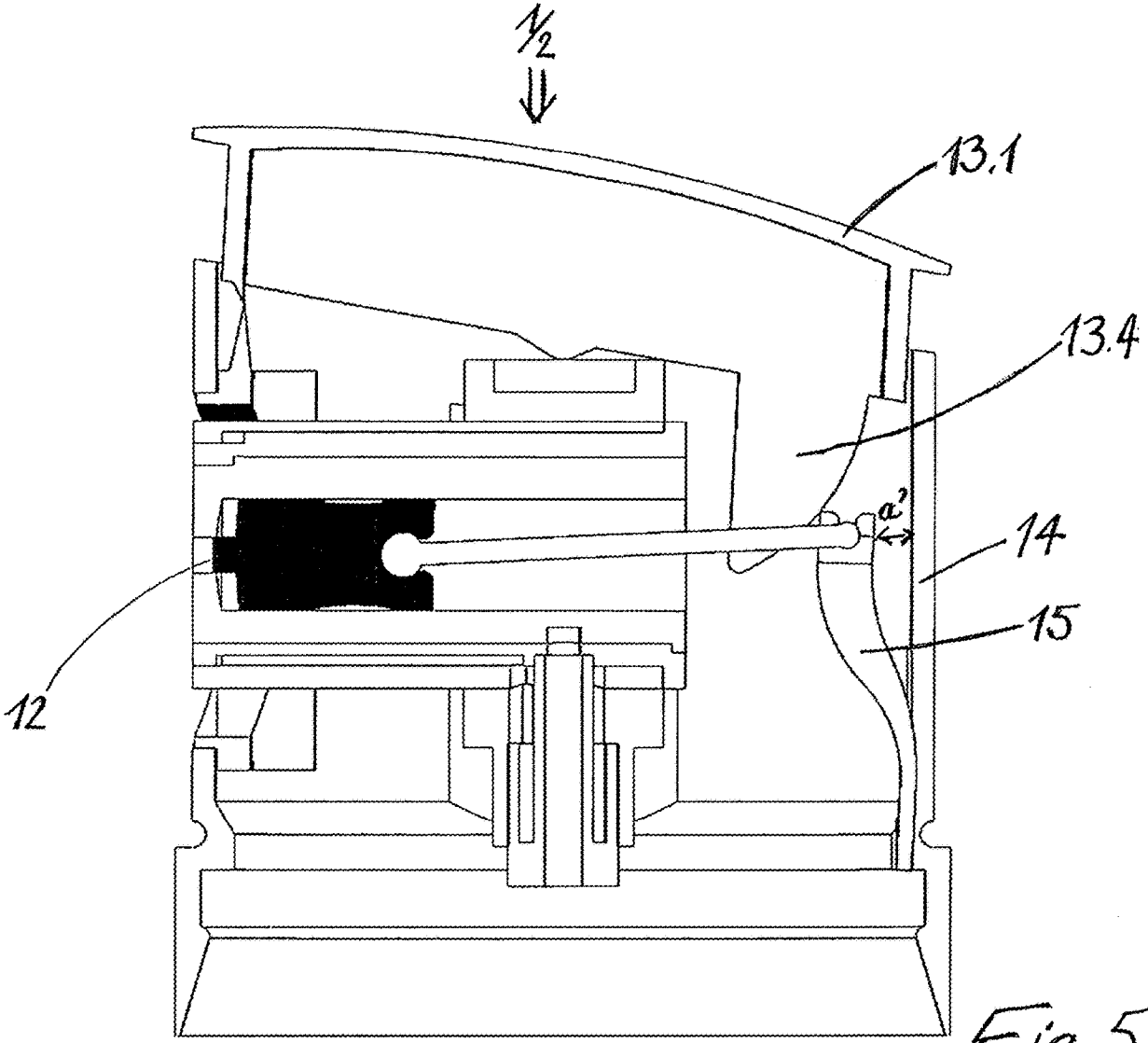

FIG. 5*b* reproduces the state in which the button (13.1) has been pressed halfway in the direction of the valve (7). The distance a' between the casing (14) and bending spring (15) has decreased compared with the distance a in FIG. 5 by the action of the eccentric cams (13.4) on the bending spring. The piston has been retracted as a result to such an extent that the dispensing duct (9.2) is completely open. In this state, the valve (7) is not yet open.

Figure 5C:
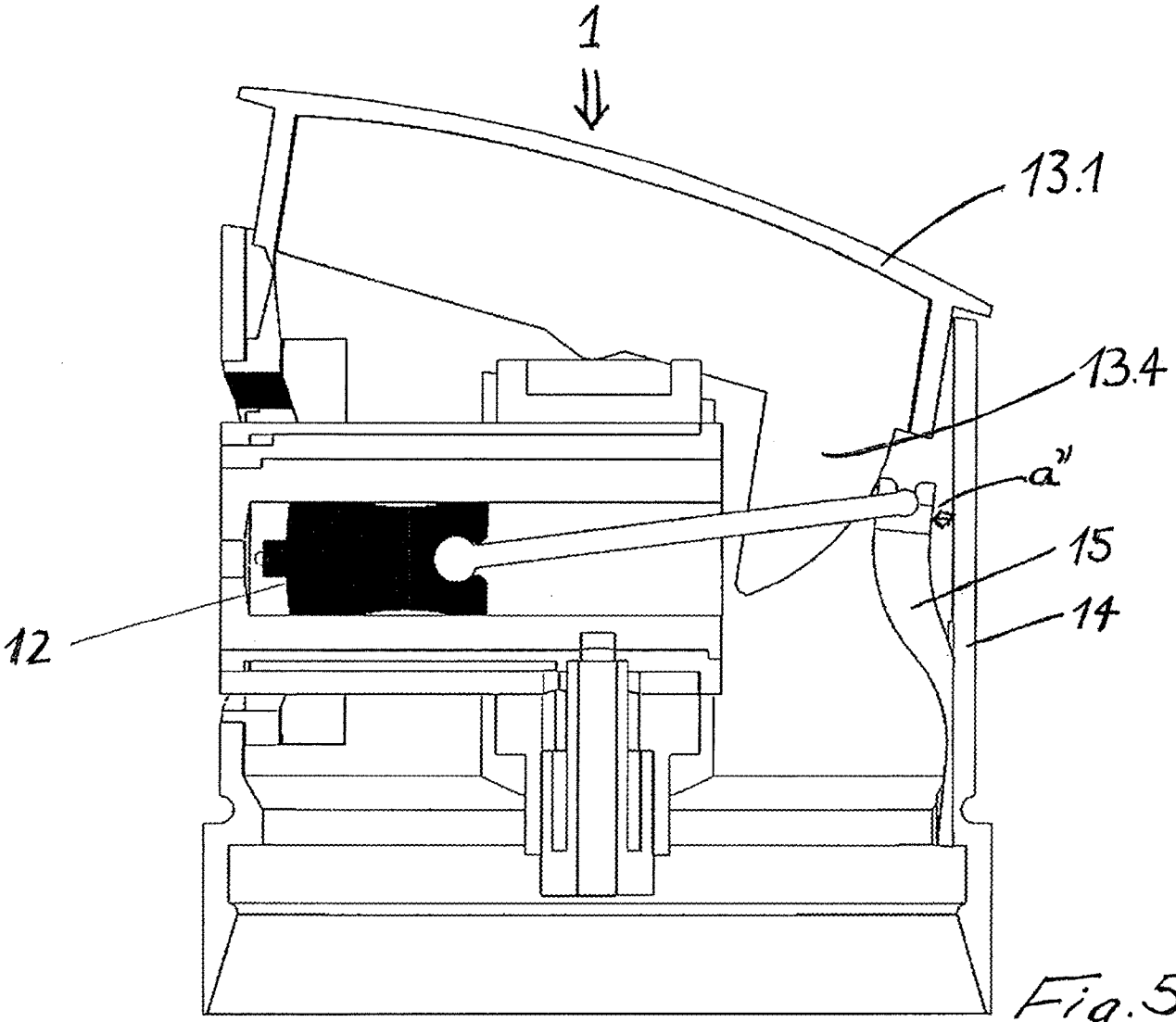

FIG. 5*c* shows the state in which the button (13.1) has been completely pressed and the mixing chamber piston (12) has been completely retracted. In this case, the distance a" between the casing (14) and bending spring (15) has decreased to a maximum extent. In this state, the valve (7) is open and the subcomponent A can flow via the passage (9.3) into the mixing chamber (9.1). The inlet opening (9.5—not visible on account of the illustration) for subcomponent B is likewise open.

If the pressure on the button (13.1) is released, the valve (7) pushes the valve attachment and the button into the starting position (FIG. 5*a*). In the process, the bending spring (15) moves into the starting position at a maximum distance a from the casing (14), with the result that the mixing chamber piston (12) slides in the direction of the dispensing duct and delivers the mixture AB present in the mixing chamber out of the dispensing duct. In the system according to the invention, in the state in which no dispensing of the mixture takes place, there is also no mixture in the mixing chamber or the dispensing duct.

In the rest state, in which no dispensing of a mixture takes place, the piston is in a forward position in the dispensing duct or mixing chamber and as a result closes the openings of the mutually opposite inlet ducts in the side wall of the dispensing duct or mixing chamber. The piston is designed such that it completely fills the mixing chamber as far as the dispensing opening. In the example shown, the dispensing opening has a smaller diameter compared with the dispensing duct. The dispensing opening is completely closed by the corresponding design of the piston. Thus, no residues can form and clog the dispensing duct.

The present embodiment described by the figures is designed for a commercially available system made up of a valve with two coaxial ducts in a stem. Systems are also available in which the valves have two or more valve stems, or systems which consist of two or more separate cans that are connected together by a supporting structure. The duct routing in the dispensing head has to be accordingly adapted.

The whole can also be applied to a pressureless container with two or more chambers and two or more pumps or in an analogous manner to two or more separate containers that each have a pump. There are also further possibilities, known to a person skilled in the art, for feeding pressurized fluids into such a dispensing head.

According to the invention, the application direction does not have to be horizontal but can also point obliquely upwards or downwards or vertically upwards. The mechanism of the button and of the piston has to be adapted accordingly. By way of a corresponding design via deflections, the dispensing direction can also be decoupled from the direction of movement of the piston.

Figures 7A, 7B:
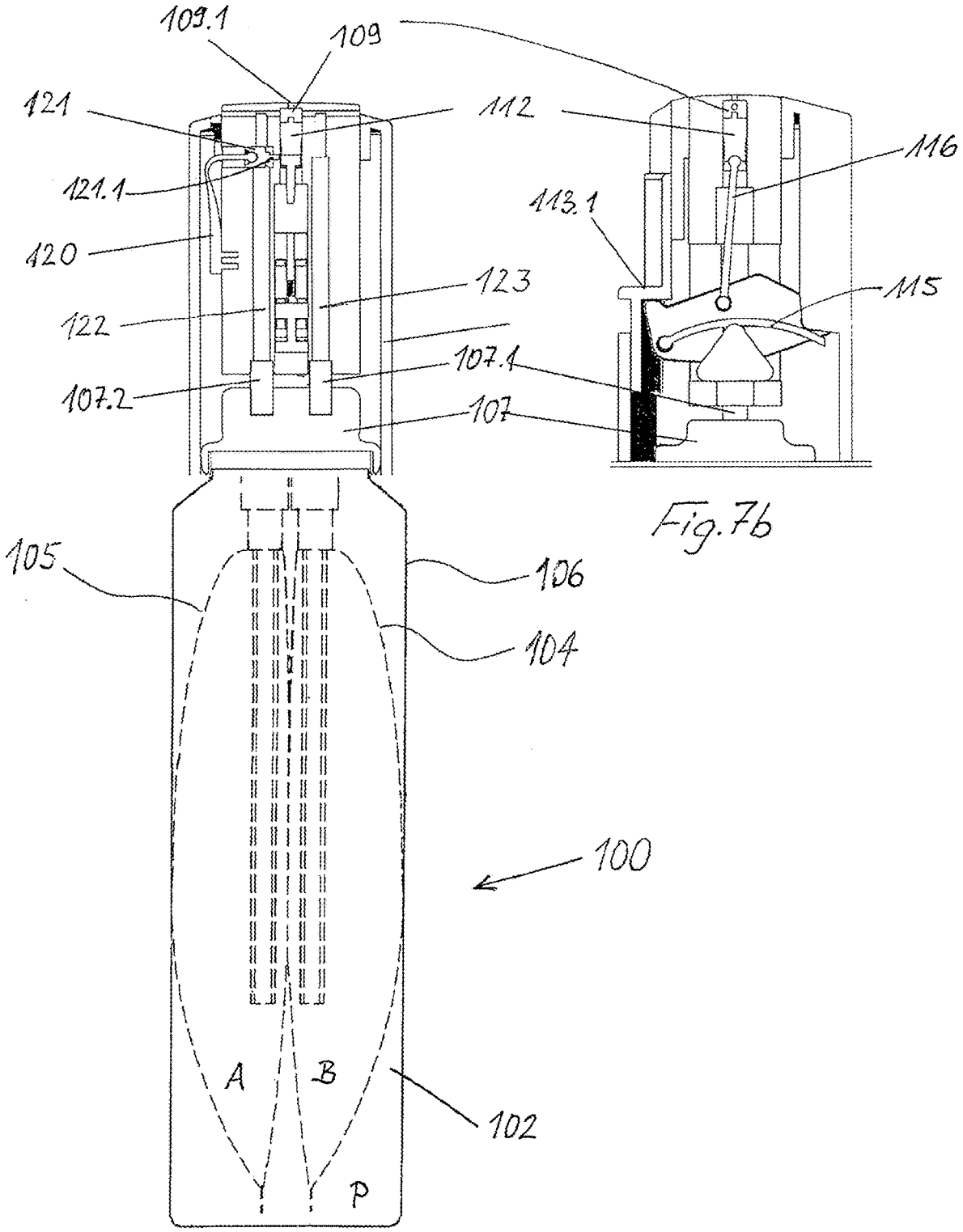

FIG. 7 shows a multicomponent applicator (100) according to the invention, having a dispensing opening and safety device oriented parallel to the main axis, having a multichamber container (102) with a removal apparatus (103), referred to as dispensing head in the following text. This container (102) contains two chambers (104) and (105), which are enclosed by the container (106). The container is closed with a valve group (107) having two separate valves with a separate outlet (stem) (107.1) and (107.2) from which the subcomponents contained in the chambers can emerge separately. In the interior of the container, the two ducts of the valve assembly are each connected to a bag made of composite plastic/aluminum film, the chambers, which are filled with the subcomponents (A) and (B). The container is subjected to a positive gas pressure (P) (compressed air or some other propellant), which exerts a pressure on the chambers (bag-in-can arrangement, for example multichamber container according to EP 2886625 A).

The dispensing head (103) has a cylindrical casing (114), via which it is held on the multichamber container (102).

The multichamber applicator reproduced in FIG. 7 has a safety device consisting of a spring element (120) and a safety piston (121). The safety piston (121) has at its front end a blocking element (121.1), which projects through the wall of the connecting duct and out under the mixing chamber piston (112) and prevents the mixing chamber piston from being able to move in the mixing chamber. The safety piston is arranged in the connecting duct (122) for the subcomponents A such that a buildup of pressure in the connecting duct leads to the safety piston (121) being pushed out transversely to the connecting duct, with the result that the blocking element (121.1) is retracted and the movement of the mixing chamber piston (112) is enabled. To this end, the safety piston has, on a connecting duct side facing the storage chamber, a notch or flattened portion, behind which the subcomponents A can flow.

Figure 8D:
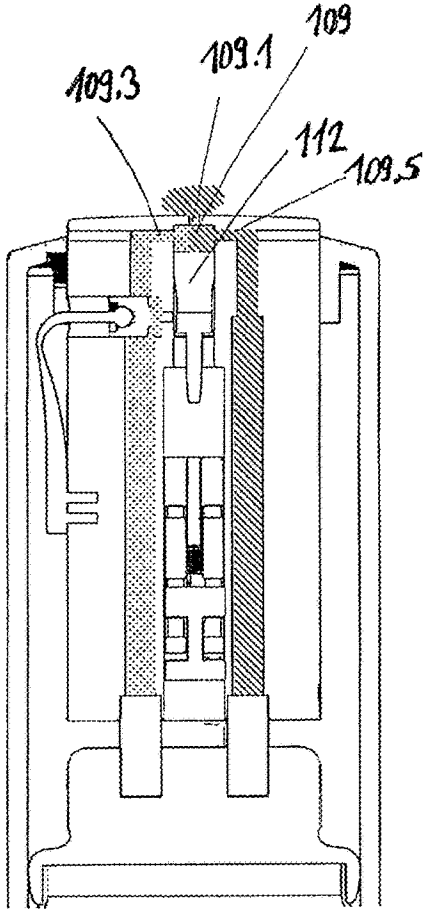
FIGS. 8*a* to *d* schematically show the movement of the mixing chamber piston in conjunction with the safety device during dispensing FIG. 9 schematically shows a dispensing head with two safety devices The following reference signs are used for the six parts.
Figure 8C:
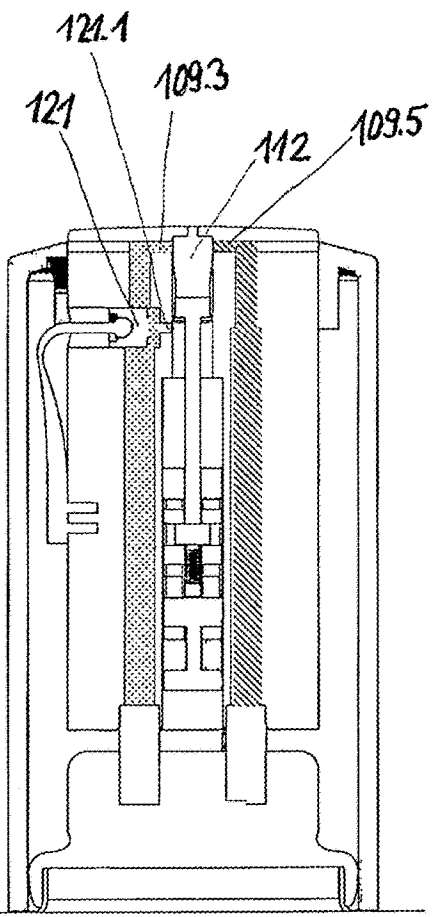
Figure 8B:
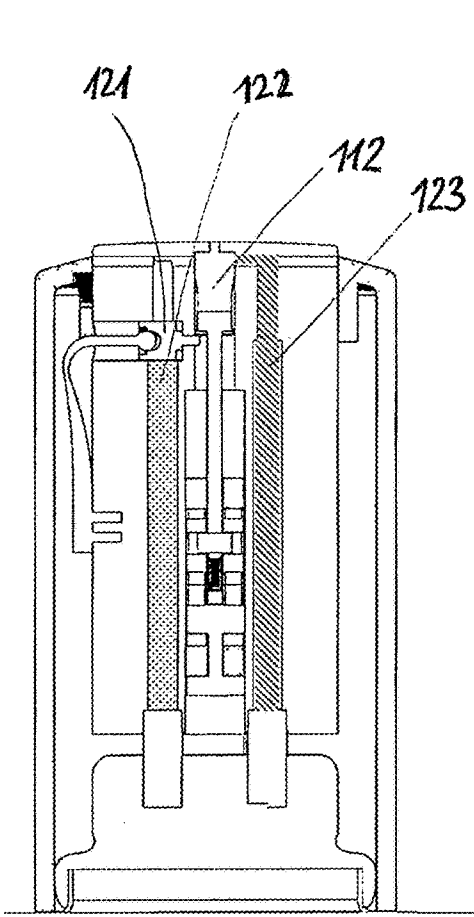
Figure 8A:
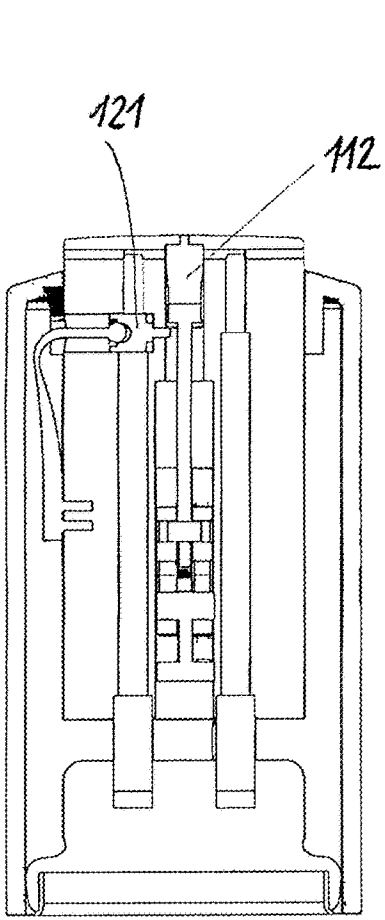

The operating principle of the dispensing head is reproduced schematically in FIGS. 8*a* to *d*. FIG. 8*a* shows the rest position. The button for releasing dispensing is in the top position, the can valve is closed. The mixing chamber piston (112) entirely fills the mixing chamber and in the process also closes the passages (109.3) and (109.5) that represent the inlet for the subcomponents into the mixing chamber. The safety piston (121) is in the blocking position (rest position) and blocks, with the blocking element (121.1), the mixing chamber piston (112).

FIG. 8*b* shows the state in which the button has been partially depressed and the can valve is open. The partial preparations flow into the connecting ducts (122) and (123). The mixing chamber is still completely filled with the mixing chamber piston. In the connecting duct (122), the subcomponent A has advanced as far as the safety piston. The subcomponent B has already been able to advance as far as the passage (109.5) but is prevented from entering the mixing chamber by the mixing chamber piston (121).

If the pressure of the subcomponent A in the connecting duct (122) is enough to move the safety piston (121) out of a rest position, the piston is pushed out of the duct (active position) and the subcomponent A can flow as far as the mixing chamber (FIG. 8*c*). As a result of the safety piston being retracted, the blocking element (121.1) was pulled away from under the mixing chamber piston, with the result that the latter can slide down and open the mixing chamber (109) (FIG. 8*d*). The mixture of the subcomponents can subsequently pass out of the dispensing opening (109.1).

Figure 9:
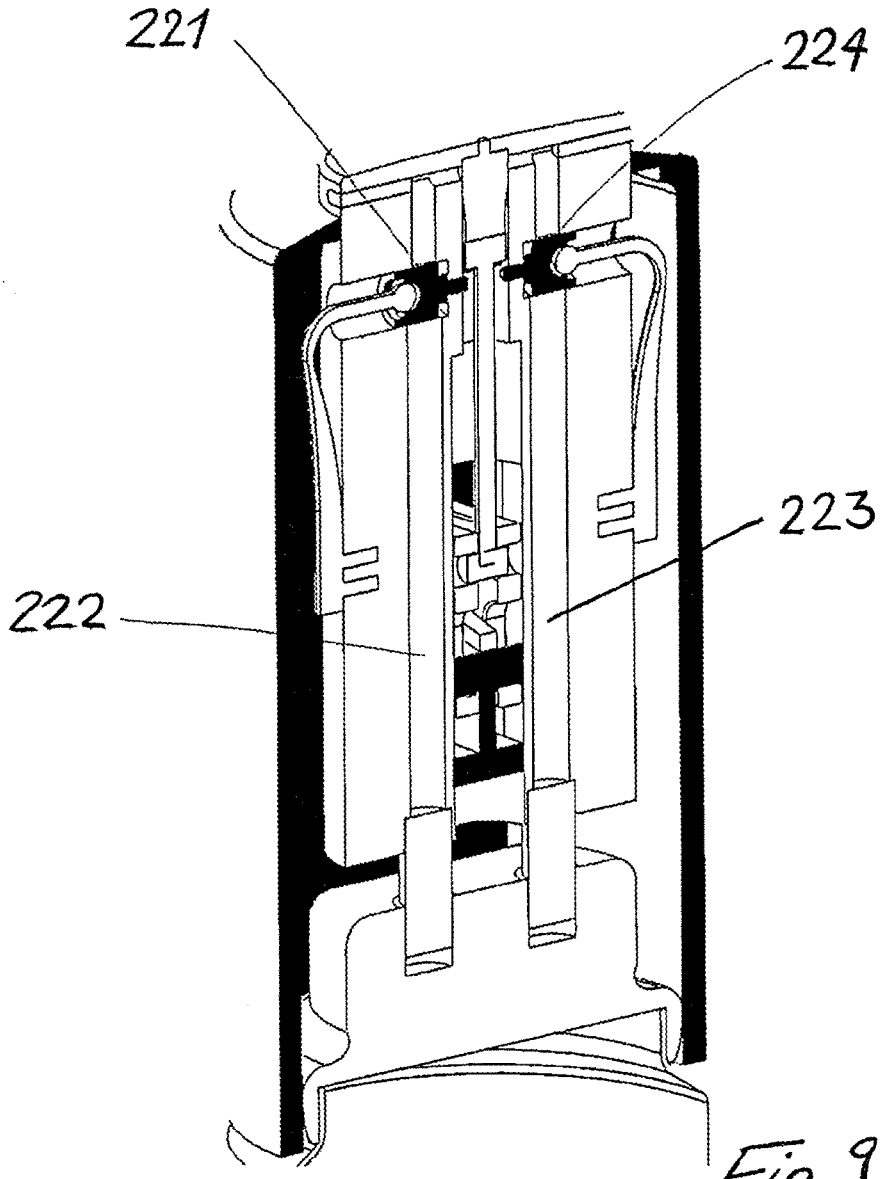

FIG. 9 schematically shows a dispensing head with two safety devices. Only when sufficient pressure has built up in both connecting ducts (222) and (223) do the safety pistons (221) and (224) move out of the rest position into the active position and as a result enable the movement of the piston (212) in the mixing chamber. As a result of the retraction of the mixing chamber piston (212) that then takes place, the inlet openings (209.3) and (209.5) of the mixing chamber are opened, with the result that the subcomponents can flow into the mixing chamber (209). If one of the two subcomponents is no longer present in a sufficient quantity to bring the respective safety piston into the active position, the mixing chamber piston remains blocked.

In the application for a mass-consumption product, it is appropriate to produce the dispensing head from a plastics material. A large number of resins and thermoplastics which can be used depending on their compatibility with the subcomponents are known to a person skilled in the art from the prior art. PP, PE, PA, PS, SAN, ABS or PET have specific advantages and drawbacks, but are in principle suitable for the construction of a dispensing head and multichamber component according to the invention.

Injection-molded parts made of PP and PE are preferred.

Injection-molding is the first choice of manufacturing method for large quantities. However, this dispensing head can also be produced by drilling, milling, turning and a large number of additive manufacturing processes.

The mixing performance of the chamber can be increased by an appropriate design of the flow ducts. By way of an approximately tangential direction of inward flow, an additional rotational flow can be introduced into the mass to be mixed, resulting in more intensive blending.

In formulations which do not provide equal volume fractions (1:1), it is possible to achieve a different mixing ratio by way of different cross sections of the inflow ducts and valves/pumps. Likewise, with a different viscosity, a mixing ratio of 1:1 can be created by a corresponding design.

The mixing chamber does not have to be cylindrical in cross section, and other shapes, such as square, elliptical, inter alia, are possible.

The outlet opening does not have to lie on the axis of the mixing chamber. In particular in the case of mixing ratios other than 1:1, an off-center position is advantageous.

What is claimed is:

1. A multi-component applicator, wherein the applicator comprises at least two chambers within the applicator for in each case at least one subcomponent (A, B), at least one removal apparatus comprising at least one directing element for directing the subcomponents from the at least two chambers into at least one dispensing duct which comprises separate inlet openings to the at least two chambers as well as an outlet, and a piston that is axially displaceable in the duct between at least two positions such that in a starting position, the outlet and the inlet openings are closed, and in an end position, the outlet and the inlet openings are open.

2. The multi-component applicator of claim 1, wherein the applicator comprises at least two chambers for in each case one subcomponent (A, B), an apparatus, connected to the at least two chambers, for removing the subcomponents contained in the chambers and comprising at least one element for directing each subcomponent stream, at least one dispensing duct, in which the subcomponent streams are combined and the subcomponents are mixed and which comprises a separate inlet opening for each subcomponent, a mixing chamber, and a dispensing opening from which a mixed partial preparation can emerge, the mixing chamber being in the form of a rectilinear hollow body and the dispensing duct comprising on an inside thereof a piston which is displaceable in a form-fitting and sealing manner along a main axis of the dispensing duct, such that the dispensing opening is closed in an end position and the mixing chamber and the inlet openings are open in an opposite end position, and the subcomponents can enter the dispensing duct and emerge from the dispensing opening.

3. The multi-component applicator of claim 2, wherein the mixing chamber is cylindrical or tubular.

4. The multi-component applicator of claim 1, wherein one or more chambers are under an external pressure that is higher than an ambient pressure of the applicator.

5. The multi-component applicator of claim 1, wherein the applicator comprises a bag-in-can system.

6. The multi-component applicator of claim 1, wherein the applicator comprises a system having piston chambers as the at least two chambers for the subcomponents.

7. The multi-component applicator of claim 1, wherein one or more chambers have an internal pressure that is higher than an ambient pressure of the applicator.

8. The multi-component applicator of claim 7, wherein the applicator is at least one aerosol container pressurized with propellant.

9. The multi-component applicator of claim 1, wherein the element for directing the subcomponent stream is a valve.

10. The multi-component applicator of claim 1, wherein the element for directing the subcomponent stream is a pump.

11. The multi-component applicator of claim 1, wherein the applicator further comprises at least one safety device which is capable of blocking a movement of the piston.

12. The multi-component applicator of claim 11, wherein the safety device comprises a spring element, a connecting duct, a mixing-chamber piston, and a safety piston, the spring element acting on the safety piston, the safety piston being arranged in the connecting duct such that the safety piston closes the latter and/or a further connecting duct and blocks the mixing-chamber piston, the connecting duct establishing a connection between the chamber and a dispensing duct inlet, and the safety piston being moved from a first position into a second position when a pressure is built up in the connecting duct by a subcomponent contained in the chamber.

13. The multi-component applicator of claim 12, wherein as a result of the safety piston moving into a second position, the blocking of the mixing-chamber piston is undone.

* * * * *